US005913610A

United States Patent [19]

Duck

[11] Patent Number: 5,913,610

[45] Date of Patent: Jun. 22, 1999

[54] PORTABLE FLUSH TOILET AND ENCLOSURE

[75] Inventor: Howard M. Duck, Dahlonega, Ga.

[73] Assignee: PolyPortables, Inc., Dahlonega, Ga.

[21] Appl. No.: 09/019,918

[22] Filed: Feb. 7, 1998

[51] Int. Cl.[6] ..... E03D 1/00

[52] U.S. Cl. ..... 4/321; 4/476; 4/317

[58] Field of Search ..... 4/321, 460, 476, 4/323, 317, 663, 664, 459

[56] References Cited

U.S. PATENT DOCUMENTS

| | | | |
|---|---|---|---|
| 1,303,358 | 5/1919 | Montgomery | 4/321 |
| 3,423,766 | 1/1969 | Eger | 4/321 |
| 4,028,746 | 6/1977 | Huck | 4/10 |
| 4,163,294 | 8/1979 | Patterson | 4/111 |
| 5,398,465 | 3/1995 | Tagg | 52/79.1 |
| 5,500,960 | 3/1996 | Tagg | 4/321 |

*Primary Examiner*—David J. Walczak
*Attorney, Agent, or Firm*—Kenneth S. Watkins, Jr.

[57] ABSTRACT

A portable flush toilet and enclosure comprises an operating mode and a storage mode. In the operating mode, a flush toilet inside a personnel enclosure or cabana is connected to a first waste tank external to the enclosure. A second waste tank external to the enclosure receives liquid waste from the first waste tank. The second waste tank provides flush fluid to the flush tank. In the storage mode, the first waste tank and the second waste tanks are disconnected from the flush toilet and flush tank and stored within the enclosure.

16 Claims, 5 Drawing Sheets

PORTABLE FLUSH TOILET AND ENCLOSURE

BACKGROUND OF THE INVENTION

The present invention relates to portable toilets and, more particularly, to portable toilets in self-contained enclosures or cabanas.

Use of portable toilets has become more prevalent as demand for outdoor construction activities, public events and convenience grows. Portable toilets offer a low cost and transportable method of providing employees and the general public private and environmentally friendly waste handling facilities. Further need for these facilities is expected to grow as legislation and building codes require ever-increasing access to such facilities.

Portable toilet facilities often utilize a waste tank directly below the waste bowl of a toilet. The waste tank is interior to the toilet enclosure or cabana and gravity provides the means for the waste to directly fall into the tank. The waste tank is pumped and flushed as required. While this method is simple and low in cost, the user is subject to the unsightly opening to the waste tank and subject to unpleasant vapors and odors emanating from the waste tank. This type of toilet also has limited waste capacity since waste must be stored below the toilet seat level.

Recirculating toilets have been used in portable toilet facilities. An example of this type of facility is disclosed by Tagg in U.S. Pat. No. 5,398,465. The waste bowl of the toilet located in the enclosure discharges to an internal waste tank. A fresh or recirculating flush fluid is pumped to the waste bowl to aid in discharging the waste into the internal waste tank. This type of unit often utilizes a chemical mixed in the flush fluid to reduce odors but the waste conduit is still open between the waste tank and the interior of the enclosure, resulting in unpleasant odors and vapors.

Patterson discloses the use of a pump to pump the waste from an enclosed toilet to an external waste tank in U.S. Pat. No. 4,163,294. Aeration and heating is used to treat the waste. The facility requires large, heavy processing equipment and still leaves the interior waste tank open to the enclosure.

Standard flush type toilets provide a significant flush volume released during the flushing evolution which allows the waste to be carried to a remote tank or processing facility. However, these types of toilets require large amounts of flushing fluid, normally fresh water, and require the waste tank to be located below the toilet discharge. These disadvantages have limited the use for portable toilet enclosures.

OBJECTS AND SUMMARY OF THE INVENTION

Therefore the object of the present invention provides a toilet enclosure which utilizes a flush toilet and a waste tank separated from the waste bowl of the toilet, thereby reducing odors and vapors to which the user is subjected.

A further object of the present invention is to provide a portable flush toilet and enclosure which utilizes a vapor trap between the flush toilet and waste tank.

A further object of the present invention is to provide a portable flush toilet and enclosure which blocks the view of waste tank contents from the user.

A further object of the present invention is to provide a portable flush toilet and enclosure which provides waste capacity greater than that available from a waste tank permanently mounted interior to the enclosure.

The flush toilet and enclosure comprises a flush toilet mounted in an enclosure or cabana sized to allow entry and use by a human. The enclosure comprises an entry door, a top, a bottom and at least one side wall. The flush toilet and enclosure has an operating mode and a storage mode. In the operating mode, at least one waste tank outside the enclosure is connected to the flush toilet located inside the enclosure by a waste conduit containing a loop seal to seal odors from the waste tank from the waste bowl of the toilet. The waste tank is connected to the waste conduit by a releasable connection. The waste tank is sized to be disconnected from the waste conduit and placed inside the enclosure in the storage mode.

Alternative embodiments utilize two external waste tanks in the operating mode. The first or lower external tank receives the waste flushed from the waste bowl of the flush toilet. The waste inlet to the first tank is located approximately level with the waste conduit of the flush toilet. A second or upper waste tank is located above the first waste tank and supplies flush fluid to a flush tank located inside of the enclosure. The second waste tank is charged with fresh water to provide initial fresh flush water to the flush tank. A pump located in the first waste tank pumps the liquid portion of the first waste tank to the second waste tank when the level of the first waste tank approaches the bottom of the waste conduit connection to the tank. A second pump located in the second waste tank pumps the flush fluid to the flush tank in the enclosure. Both the first and second waste tanks can be removed and stored inside the enclosure for storage and transporting of the apparatus.

Other embodiments of the invention utilize an auxiliary waste tank which receives overflow from the second waste tank to increase capacity of the apparatus.

BRIEF DESCRIPTION OF THE DRAWINGS

These and other features, aspects and advantages of the present invention will become better understood with regard to the following description, appended claims and accompanying drawings where:

DESCRIPTION OF THE PREFERRED EMBODIMENTS

The following is a description of the preferred embodiments of a portable flush toilet that is self contained and easy to store and transport.

For the purposes of this disclosure, a flush toilet is a toilet utilizing a predetermined amount of flush fluid stored in a tank above the waste bowl, and utilizes a flush mechanism which directs the flush fluid into the waste bowl via a flush conduit upon activation of the flushing mechanism.

Figure 1:
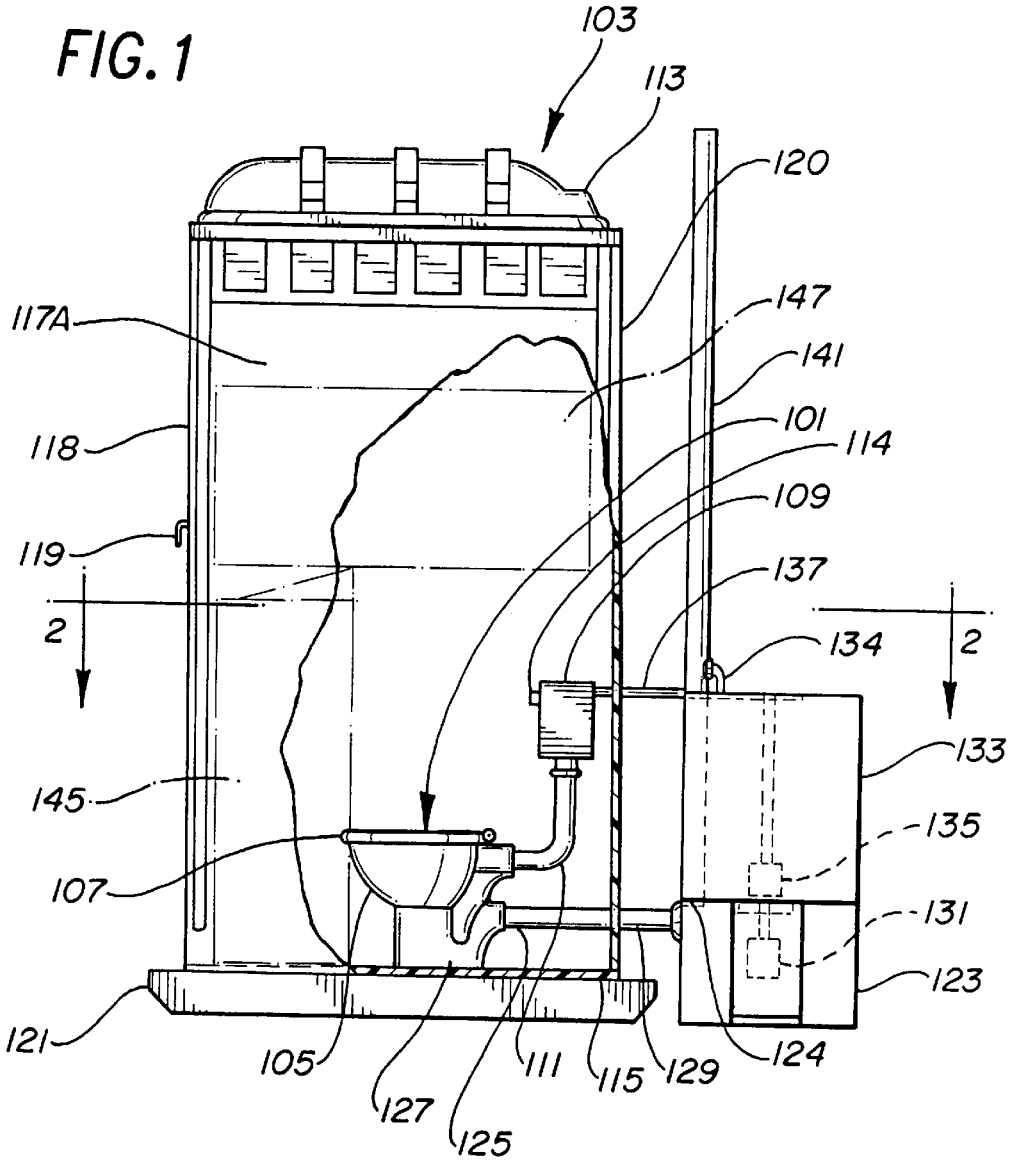
FIG. 1 is an elevation drawing of an embodiment of the flush toilet and enclosure showing the flush toilet located interior to the enclosure, part of a wall of the enclosure broken away to show the interior components of the enclosure, and two external waste tanks, the figure also showing the storage mode location of the waste tanks in phantom lines.

FIG. 1 is a side elevation drawing of an embodiment of the flush toilet and enclosure showing flush toilet 101 inside toilet cabana or enclosure 103. Flush toilet 101 comprises a waste bowl 105, toilet seat 107 and a flush tank 109. In the preferred embodiment, flush tank 109 is mounted external to waste bowl 105 and connected to waste bowl 105 by a flush conduit 111. In other embodiments, flush tank 109 is mounted on waste bowl 105. A flush mechanism (not shown) is actuated by flush lever 114 on flush tank 109 to initiate flush water discharge from flush tank 109 to waste bowl 105. Flush mechanisms are known by those skilled in the art and not part of the invention.

Enclosure 103 is sized to allow entry and use by a person and comprises top 113, bottom 115, side wall 117A, front wall 118, front access door 119 and back wall 120. Bottom skids or runners 121 attached to bottom 115 provide support for the enclosure from the ground or other surface and provide a means for lifting the enclosure. For example, a clearance between bottom 115 of the enclosure and the ground provided by skids 121 allow a fork lift truck to insert lifting forks between bottom 115 and the ground or floor below the enclosure.

Waste bowl 105 of flush toilet 101 is connected to first or lower waste tank 123 by a waste conduit 125. Waste tank 123 is located external to enclosure 103 in the operating mode. Waste conduit 125 comprises a loop seal or "P" trap 127 and connecting pipe 129. Loop seal 127 provides a seal for odors and vapors between waste bowl 105 and waste tank 123. The seal is the result of liquid remaining in the bottom of the loop after flushing of the waste bowl, thereby cutting off a free flow path for odors and vapors from waste tank 123 back to waste bowl 105. Loop seal 127 may be integral to waste bowl 105 as shown in the figure, or, it may be separate and located in connecting pipe 129.

In the preferred embodiment, pump 131 of waste tank 123 pumps the liquid portion contents of waste tank 123 to second or upper waste tank 133. In the operating mode, waste tank 133 is external to enclosure 103. In the preferred embodiment, waste tank 133 is located above waste tank 123. Waste tank 133 stores the liquid portion of waste pumped from waste tank 123 as well as an initial charge of fresh flushing water. Pump 131 is initiated by high liquid level in waste tank 123.

Upon flushing of toilet 101, low level in flush tank 109 activates pump 135 of waste tank 133 and refills flush tank 109 through flush tank supply conduit 137. Vent pipe 141 vents waste tank 123 at connection 124 and waste tank 133 at connection 134 and prevents pressure buildup in the tanks.

Figure 2:
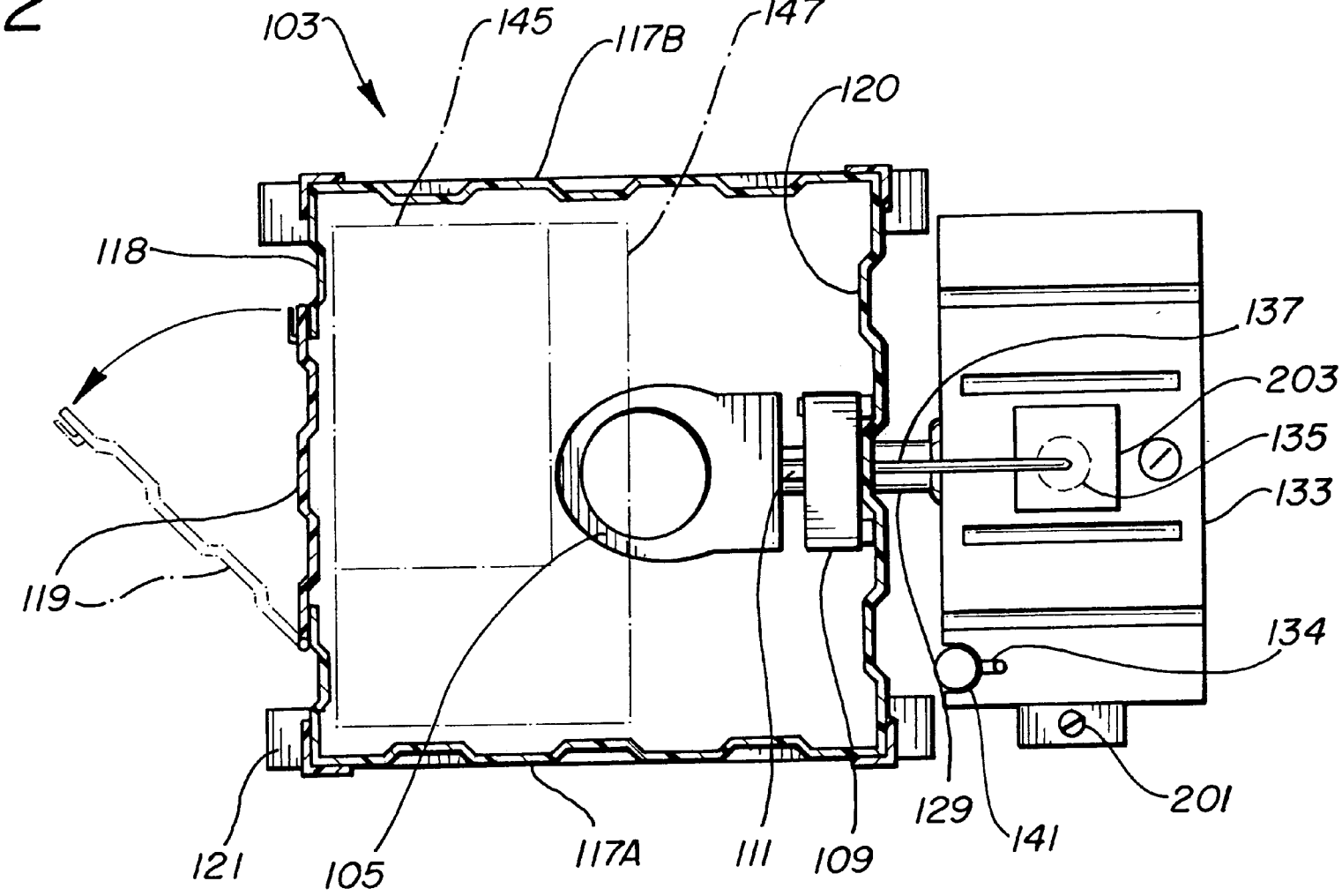
FIG. 2 is a cross-section drawing of the enclosure of FIG. 1 taken at lines 2—2 of FIG. 1, and a top view of the waste tanks of FIG. 1, the figure also showing the storage mode location of the waste tanks in phantom lines.

FIG. 2 is a cross-section of toilet enclosure 103 taken at lines 2—2 of FIG. 1. Toilet enclosure 103 comprises side walls 117A and 117B, front wall 118, back wall 120 and personnel door 119. In other embodiments, enclosure 103 has an oval, circular or polygon cross-section. Waste bowl 105 of toilet 101 connects to waste tank 123 (located below waste tank 133) through waste pipe 129. Flush tank 109 mounts to back wall 120. Clean-out 201 of waste tank 123 is used to pump out and clean waste tank 123. Pump access plate 203 of waste tank 133 supports pump 135 and allows access to pump 135 and associated piping and electrical wiring (not shown). Flush tank supply conduit 137 provides flush water to flush tank 109 from waste tank 133. In an alternative embodiment, flush tank 109 is mounted external to enclosure 103, for example on the outside surface of back wall 120.

Figure 3:
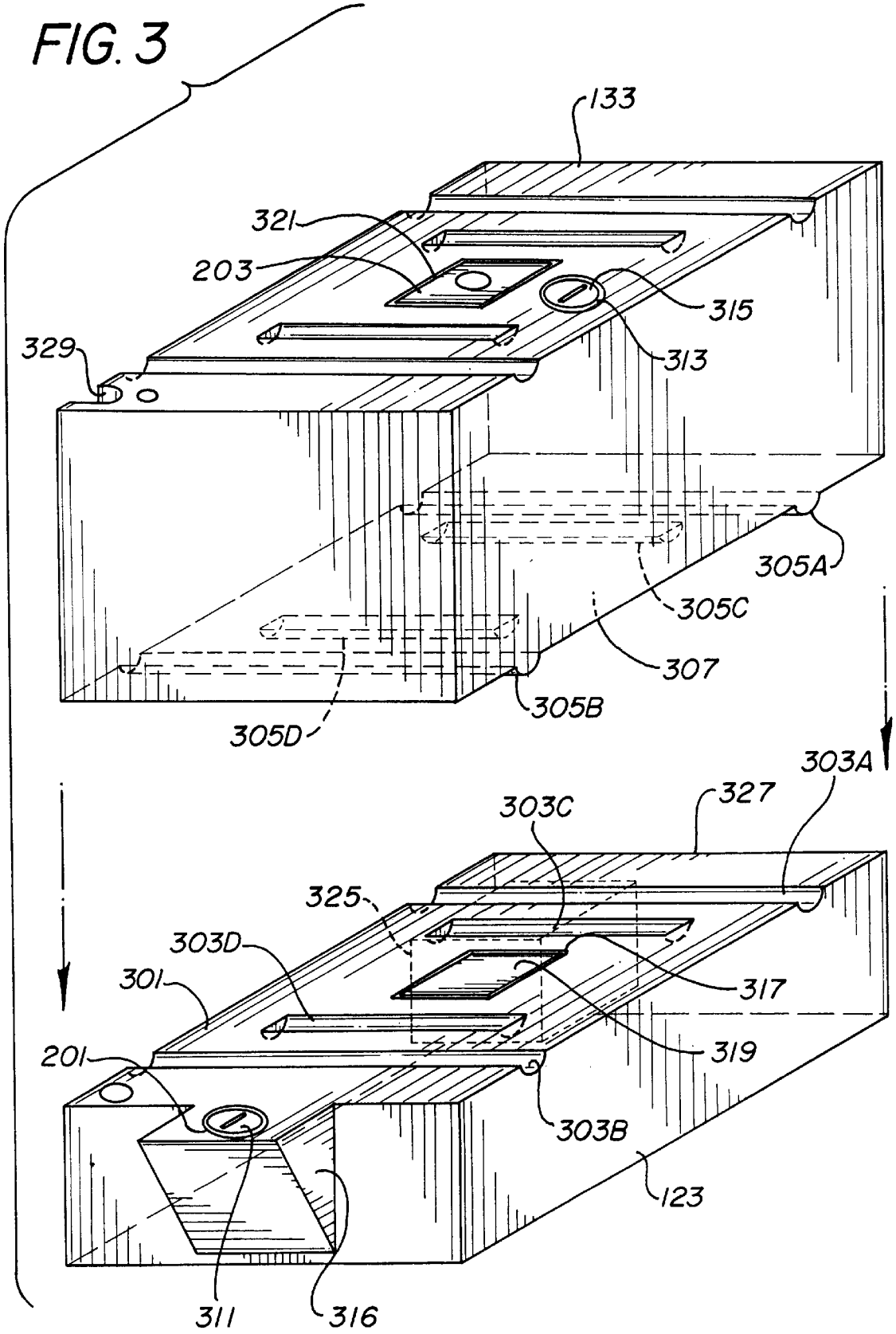
FIG. 3 is a perspective view of the upper and lower waste tanks of FIG. 1 showing interlocking features of the tanks, and the pump access, clean-out and vent connections to the tanks.

FIG. 3 is a perspective drawing of waste tanks 123 and 133. Top 301 of waste tank 123 comprises concave stiffeners 303A and 303B. Convex stiffeners 305A and 305B on bottom 307 of waste tank 133 interlock with stiffeners 303A and 303B when tank 133 is placed on tank 123 as indicated by the arrows in the figure. Stiffeners 303A, 303B, 305A and 305B prevent longitudinal movement of tanks 123 and 133 with respect to each other, improving the stability of the tank structure. Partial length convex stiffeners 305C and 305D (shown in broken lines) of tank bottom 307 interlock with partial length concave stiffeners 303C and 303D of tank top 301 to prevent lateral movement of tank 133 with respect to tank 123. Other interlocking means such as raised ledges (not shown) around top of tank 123 may be used to stabilize the tanks. Additional stiffeners (not shown) may be used on the top, bottom and sides of the tanks as required to reduce the wall thickness and weight of the tanks.

Clean-out 201 of waste tank 123 provides an access port for pumping out waste contents of the tank as well as flushing and inspecting the tank. Cover 311 provides a removeable cover for clean-out 201. Likewise, clean-out 313 of waste tank 133 provides an access port for pumping out waste, cleaning and inspection of the tank. Clean-out 313 also provides a location for charging the initial flush fluid for the flush tank. Cover 315 provides a removeable cover for clean-out 313. Extended portion 316 of tank 123 provides access to clean-out 201 when tank 133 is placed on tank 123.

Aperture 317 provides access to the interior of tank 123 for waste pump (131 of FIG. 1) and piping access. Pump access plate 319 provides a mount for pump 131 and associated piping shown in FIG. 4. Aperture 321 provides access to the interior of tank 133 for waste pump (135 of FIG. 1) and piping access. Pump access plate 203 provides a mount for pump 135 and associated piping shown in FIG. 4. Battery compartment 325, accessible from end 327 of waste tank 123, provides a space for mounting a battery (not shown) to supply power to pumps 131 and 135. A compartment cover (not shown) may be used to cover compartment 325 from tank end 327. Cut-out portion 329 of tank 133 provides clearance and support to vent stack 141 of FIG. 1.

Figure 4:
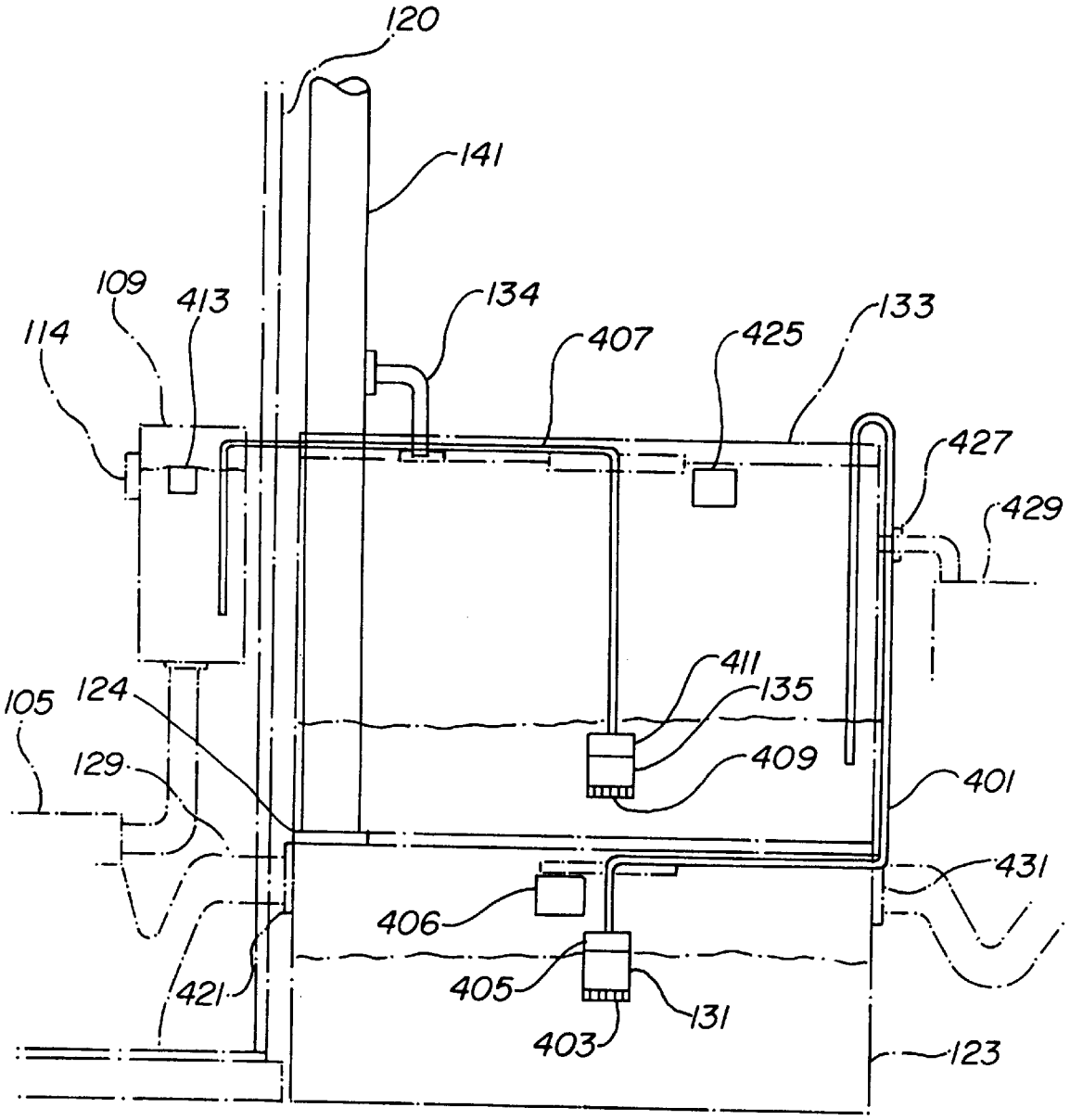
FIG. 4 is a piping drawing for the apparatus of FIG. 1.

FIG. 4 is a piping diagram showing the tank, pump piping and level switch layout for the flush toilet and enclosure. Pump 131 pumps the liquid portion contents of waste tank 123 to waste tank 133 through pipe 401. Strainer 403 prevents solid portion of waste tank 123 from clogging pump 131 or piping 401. Motor 405 provides the motive power for pump 131 and is powered by a battery (501 of FIG. 5) through level switch 406 in the circuit shown in FIG. 5.

Pump 135 pumps the liquid portion contents of waste tank 133 to flush tank 109 through pipe 407. Strainer 409 prevents clogging pump 135 or piping 407. Motor 411 provides the motive power for pump 135 and is powered by battery 501 through level switch 413 of flush tank 109 in the circuit shown in FIG. 5. Level switch 425 provides a means to cut off pumps 131 and 135 in the event of high level of waste tank 133. Waste connection 421 of waste tank 123 is shown connected to waste pipe 129 of waste conduit 125. Waste connection 421 is a releaseable connection such as an elastomeric donut connection, flange connection, union connection, or simply a cut-out aperture. Vent pipe 141 vents tank 123 through connection 124 and tank 133 through connection 134. Other connections and unions known in the art may be used to facilitate connection and disassembly of the components.

Figure 5:
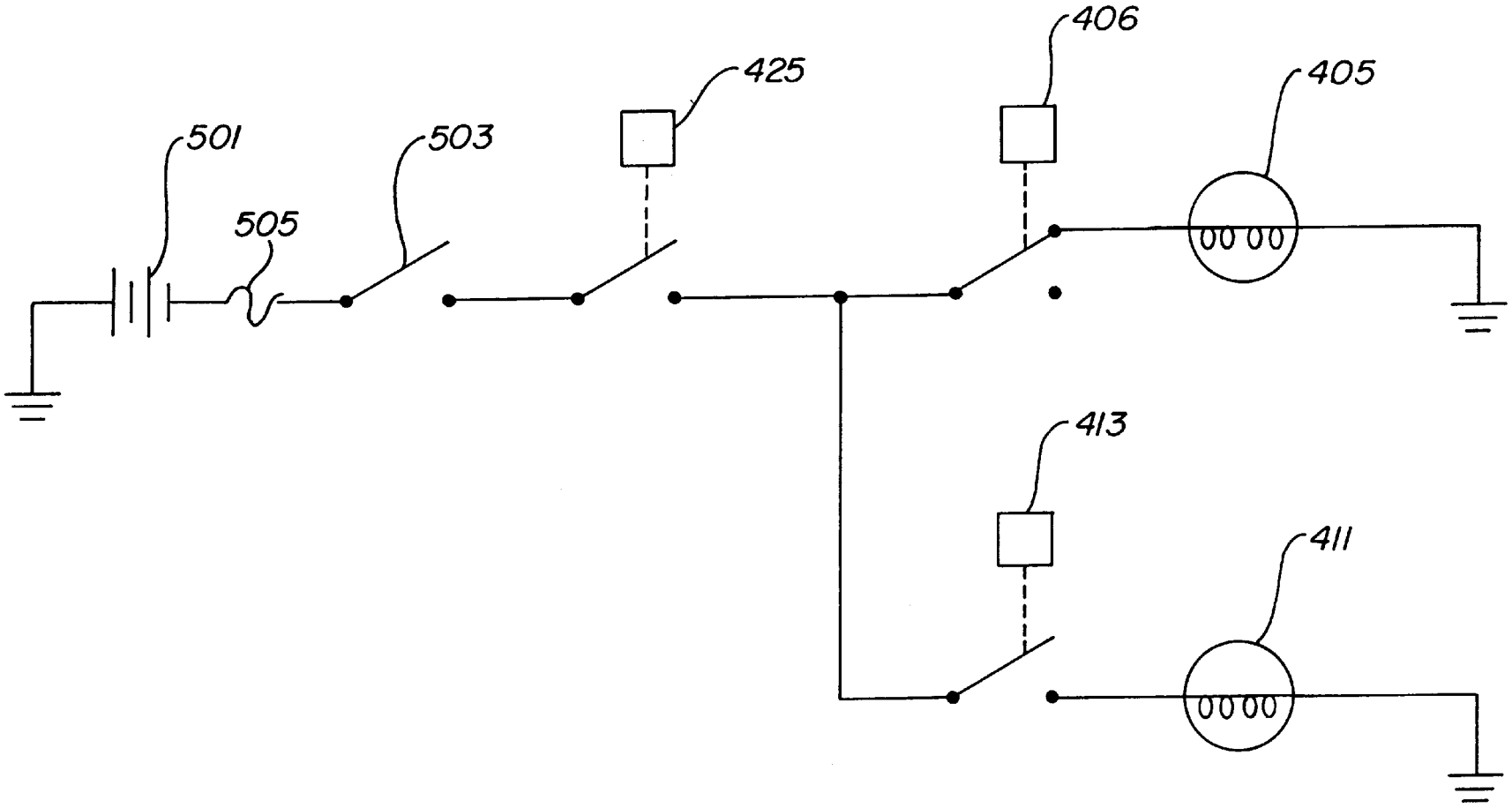
FIG. 5 is an electrical schematic diagram of the pump motors, battery and level switches of the apparatus of FIG. 1.

FIG. 5 is an electrical schematic diagram showing battery 501 supplying power to motor 405 of pump 131 through level switch 406 of tank 123. Level switch 406 is located so that the pump is activated when the level in tank 123 rises to a level approximately equal to the lower portion of connection 421 of waste tank 123. This level represents the effective full level of tank 123. Level switch 406 cuts off power to motor 405 of pump 131 when the level of waste tank 123 lowers to a level several inches below waste pipe connection 421.

Level switch 413 energizes motor 411 of pump 135 of waste tank 133 when the level in flush tank 109 falls to a level several inches below the full level. This drop in level will occur when the flush tank is flushed by lever 114, emptying flush tank 109 contents to waste bowl 105. Level switch 413 will cut off pump motor 411 when a flush flapper valve (not shown) in flush tank 109 shuts and flush tank 109 level returns to the full level. Level switch 425 of waste tank 133 cuts power to pump motor 405 of pump 131 and motor 411 of pump 135 when the level of waste tank 133 reaches a full level. A master cut off switch 503 cuts power to all components for service or maintenance. Fuse 505 protects the electrical components and wiring from excessive currents should an electrical fault occur.

In an alternative embodiment, level switch 406 is positioned to initiate pump 131 at a predetermined level less than the effective full level of tank 123. Level switch 425 in upper waste tank 133 only cuts off pump 131 in waste tank 123 when the level in tank 133 reaches a full level. A second level switch (not shown) is added to tank 123 which cuts off pump 135 when the level in tank 123 reaches the full level, thereby shutting off flush water supply to the flush tank. This embodiment increases the waste capacity of the system by reducing the amount of initial fresh water charge required in tank 133.

Waste tanks 123 and 133 are sized to allow the tanks to be placed interior to enclosure 103 in the storage mode for storage and transporting of the system. Position 145 (shown in broken lines) of FIGS. 1 and 2 show the preferred storage position of waste tank 123 interior to enclosure 103 when waste conduit 125 is released from releaseable connection 421 of waste tank 123. Position 147 (shown in broken lines) of FIGS. 1 and 2 show the preferred storage position of waste tank 133 for storage and transporting of the system. Vent 141 is stored in enclosure 103 when removed from tanks 123 and 133. Other piping and electrical components removed from tanks 123 and 133 may be stored inside enclosure 103.

In operation, tanks 123 and 133 are removed from their storage position inside enclosure 103. Lower waste tank 123 is connected to waste pipe 129 at the waste connection 421 of tank 123. Upper waste tank 133 is placed on waste tank 123 and the piping from pump 131 to waste tank 133 and from pump 135 to flush tank 109 is connected. Vent pipe 141 is connected to the waste tanks and the electrical connections between the battery, pumps and level switches made. An initial charge of fresh water is added to upper tank 133 to provide flush water to flush tank 109 until the level in tank 123 is sufficient to provide additional flush water.

Chemicals to control odors and decomposition are added to tank 133 with the initial fresh water charge, or alternatively, added by dispensers (not shown) in flush tank 109 or the waste tanks. Chemical dispensers may be of the dissolving type, or they may be of the float dispenser type. Alternatively, chemicals may be added by siphon pipes installed in the piping between waste tank 123 and 133 or between waste tank 133 and flush tank 109.

Enclosure 103 is made of plastic, metal or wood. In the preferred embodiment, the walls of enclosure 103 are made of vacuum formed plastic sheet. The top is made of vacuum formed plastic sheet, and the bottom is made of wood with a plastic sheet liner. The skids are made of wood or plastic. Tanks 109, 123 and 133 may be metal or plastic. In the preferred embodiment, tanks 109, 123 and 133 are rotationally molded polyethylene. In the preferred embodiment, the piping is made of plastic. Pumps 131 and 135 may be centrifugal, diaphragm or other sanitary design pumps.

Figure 1A:
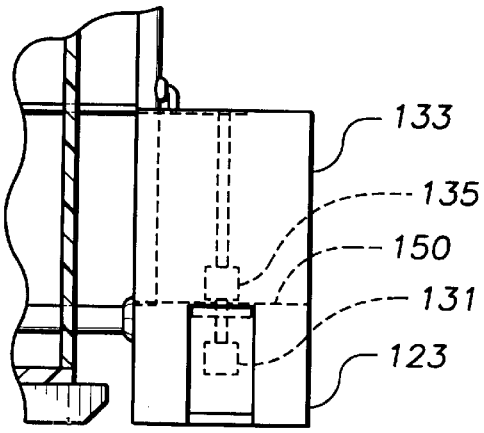
FIG. 1A is a partial elevation of an integral external waste tank of FIG. 1 showing a common partition between the tank compartments.

In another embodiment of the present invention, a single waste tank is utilized. In this embodiment, only tank 123 is utilized and pump 135 and its associated motor and piping are located in tank 123. Level switch 425 is also relocated to tank 123. This embodiment is useful for low volume, occasional use. Another embodiment combines waste tanks 123 and 133 into a single integral tank with a common wall or partition (corresponding to tank 123 top and tank 133 bottom) separating the compartments as shown by common partition 150 of integral waste tank 151 of FIG. 1A.

Another embodiment adds a third or auxiliary tank 429 at connection 427 of tank 133 of FIG. 4. Connection 427 is an overflow connection located below level switch 425 cut off position. This embodiment provides additional capacity to the system when required. Still other embodiments allow connection of additional toilets to waste tank 123. For example, a second flush toilet in a second enclosure may be connected at waste connection 431 of tank 123. This arrangement allows a single waste system to be used with two or more flush toilet enclosures, for example in a back-to-back arrangement with the tanks located between the enclosures. Additional flush supply pumps, conduits, and flush tank level switches may be used to supply flush water to the additional flush toilets. In still further embodiments, several flush toilets in the same enclosure may be connected to the same waste tank. Enclosures may contain additional fixtures such as wash basins which drain to waste tank 123.

Accordingly the reader will see that the PORTABLE FLUSH TOILET AND ENCLOSURE provides a completely portable flush toilet and enclosure with an operating mode and a storage mode. The device provides the following additional advantages:

- Odors and vapors from the waste tanks are sealed from users in the enclosure;
- The external waste tanks allow greater capacity than fixed internal tanks;
- The waste tanks are stored inside the enclosure for efficient storage and transporting of the system; and
- The device is simple and low in cost.

Although the description above contains many specifications, these should not be construed as limiting the scope of the invention but as merely providing illustrations of some of the presently preferred embodiments of this invention. For example, a large capacity pump in one of the waste tanks could provide the flush water to the waste bowl directly instead of utilizing a gravity flush tank. Or, gravity may be used to transfer flush fluid from the upper waste tank to the flush tank. Thus the scope of the invention should be determined by the appended claims and their legal equivalents, rather than by the examples given.

I claim:

1. A portable flush toilet apparatus comprising:

a portable toilet enclosure comprising a top, a bottom adapted to rest on a support surface, at least one side wall and a personnel entry door;

a flush toilet comprising a waste bowl, the flush toilet mounted inside the toilet enclosure;

a flush tank connected to the waste bowl of the flush toilet by a flush conduit; and a first waste tank adapted to rest on said support surface and be disposed in side-by-side relation to said at least one side wall and comprising a releasable connection connecting the waste bowl of the flush toilet to the first waste tank through a waste conduit comprising a loop seal when the first waste tank is outside of the toilet enclosure, the first waste tank comprising external dimensions sufficiently small to fit inside of the toilet enclosure for storage and transport when the releasable connection is disconnected from the waste bowl.

2. The apparatus of claim 1 comprising a second waste tank connected to the first waste tank by a first liquid waste conduit.

3. The apparatus of claim 2 comprising a second liquid waste conduit connecting the second waste tank to the flush tank whereby flush water is provided from the second waste tank to the flush tank.

4. The apparatus of claim 2 wherein the second waste tank is located above the first waste tank and the first liquid waste conduit comprises a first pump for pumping liquid waste from the first waste tank to the second waste tank.

5. The apparatus of claim 4 comprising a second pump in a second liquid waste conduit for pumping the liquid contents of the second waste tank to the flush tank.

6. The apparatus of claim 5 comprising a first level switch in the first waste tank, the first level switch communicating with a battery and the first pump to energize the first pump when a liquid level in the first waste tank increases to a predetermined level.

7. The apparatus of claim 6 comprising a second level switch in the flush tank, the second level switch communicating with the battery and the second pump to energize the second pump when a liquid level in the flush tank falls to a predetermined level.

8. The apparatus of claim 7 comprising a third level switch in the second waste tank, the third level switch communicating with the battery and the first pump and second pump to de-energize the first pump and the second pump when a liquid level in the second waste tank rises to a predetermined level.

9. The apparatus of claim 2 wherein the second waste tank is supported by the first waste tank and the first waste tank comprises an interlocking means for locking the second waste tank to the first waste tank.

10. The apparatus of claim 2 comprising an auxiliary waste tank overflow connection on the second waste tank for connecting an auxiliary waste tank to the second waste tank.

11. The apparatus of claim 2 wherein the first waste tank comprises a first chamber of an integral waste tank and the second waste tank comprises a second chamber of the integral waste tank, the first chamber and the second chamber separated by a partition.

12. The apparatus of claim 2 comprising a vent pipe connected to the first waste tank and the second waste tank.

13. The apparatus of claim 2 wherein the first waste tank comprises a plurality of releaseable connections for connecting a plurality of flush toilets to the first waste tank.

14. A portable flush toilet apparatus comprising:

a portable toilet enclosure comprising a top, a bottom adapted to rest on a support surface, at least one side wall and a personnel entry door;

a flush toilet comprising a waste bowl, the flush toilet mounted inside the toilet enclosure;

a flush tank connected to the waste bowl of the flush toilet by a flush conduit;

a waste tank adapted to rest on said support surface and be disposed in side-by-side relation to said at least one side wall and comprising a releasable waste connection, the waste tank having dimensions sufficiently small to fit inside of the toilet enclosure; and the apparatus comprising an operating mode wherein the releaseable connection of the waste tank is connected to the waste bowl of the toilet through a waste conduit comprising a loop seal and a storage mode wherein the releaseable connection of the waste tank is disconnected from the waste bowl and the waste tank is stored inside the enclosure.

15. The apparatus of claim 14 comprising a liquid waste conduit and pump, the liquid waste conduit and pump connected between the waste tank and the flush tank for supplying flush liquid to the flush tank in the operating mode.

16. A portable flush toilet apparatus comprising:

a portable toilet enclosure comprising a top, a bottom, at least one side wall and a personnel entry door;

a flush toilet comprising a waste bowl, the flush toilet mounted inside the toilet enclosure;

a flush tank connected to the waste bowl of the flush toilet by a flush conduit;

a first waste tank comprising a releaseable waste connection, the first waste tank comprising external dimensions sufficiently small to fit inside of the toilet enclosure; and a second waste tank, the second waste tank comprising a liquid waste connection and comprising external dimensions sufficiently small to fit inside of the toilet enclosure;

the apparatus comprising an operating mode wherein the releasable waste connection of the first waste tank is connected to the waste bowl of the flush toilet by a waste conduit, and the second waste tank is connected to the first waste tank by a liquid waste conduit when the first waste tank and the second waste tank are outside the enclosure, and a storage position wherein the first waste tank and the second waste tank are located inside the enclosure.

* * * * *